US010006390B2

(12) United States Patent
Murakami et al.

(10) Patent No.: US 10,006,390 B2
(45) Date of Patent: Jun. 26, 2018

(54) ENGINE STARTING SYSTEM

(71) Applicant: TOYOTA JIDOSHA KABUSHIKI KAISHA, Toyota-shi (JP)

(72) Inventors: Koji Murakami, Susono (JP); Koki Matsushita, Mishima (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 18 days.

(21) Appl. No.: 15/018,631

(22) Filed: Feb. 8, 2016

(65) Prior Publication Data

US 2016/0230734 A1 Aug. 11, 2016

(30) Foreign Application Priority Data

Feb. 10, 2015 (JP) ..... 2015-024168

(51) Int. Cl.
*F02D 41/04* (2006.01)
*F02D 9/02* (2006.01)
*F02N 99/00* (2010.01)

(52) U.S. Cl.
CPC ..... *F02D 41/042* (2013.01); *F02D 2009/025* (2013.01); *F02N 99/002* (2013.01)

(58) Field of Classification Search
CPC .. F02N 11/0814; F02N 99/002; F02D 41/042; F02D 2009/025
See application file for complete search history.

(56) References Cited

U.S. PATENT DOCUMENTS

2002/0165660 A1* 11/2002 Boggs ..... B60K 6/445 701/112
2003/0213454 A1* 11/2003 Grieser ..... F01L 1/34 123/179.18
2004/0123831 A1* 7/2004 Grieser ..... F02D 9/02 123/198 DB
2013/0166173 A1* 6/2013 Ideshio ..... B60W 20/00 701/103
2015/0345457 A1* 12/2015 Shoda ..... F02D 17/04 701/103

FOREIGN PATENT DOCUMENTS

JP 2004-293474 A 10/2004
JP 2010-242621 A 10/2010
JP 2010242621 A * 10/2010
WO WO 2013/061378 A1 5/2013

* cited by examiner

*Primary Examiner* — Joseph Dallo
*Assistant Examiner* — Kurt Liethen
(74) *Attorney, Agent, or Firm* — Oblon, McClelland, Maier & Neustadt, L.L.P.

(57) ABSTRACT

An engine starting system includes an electronic control unit configured to: automatically stop an engine in response to an engine stop request, and restart the engine in response to an engine restart request; calculate, in the course of automatically stopping the engine, a throttle opening degree based on at least one of a vehicle speed or an input rotational speed of a transmission, such that the throttle opening degree when the at least one of the vehicle speed or the input rotational speed is high is larger than the throttle opening degree when the at least one of the vehicle speed or the input rotational speed is low; carry out scavenging of each cylinder by opening a throttle valve to the calculated throttle opening degree in the course of automatically stopping the engine; and restart the engine through ignition-based engine starting in response to the engine restart request.

4 Claims, 9 Drawing Sheets

ENGINE STARTING SYSTEM

INCORPORATION BY REFERENCE

The disclosure of Japanese Patent Application No. 2015-024168 filed on Feb. 10, 2015 including the specification, drawings and abstract is incorporated herein by reference in its entirety.

BACKGROUND OF THE DISCLOSURE

1. Field of the Disclosure

The disclosure relates to an engine starting system configured to start an engine mounted in a vehicle.

2. Description of Related Art

There are engine starting systems configured to restart, through ignition-based engine starting, an engine that is at a standstill after being automatically stopped upon the satisfaction of a prescribed stopping condition. It has been known that, in such engine starting systems, when scavenging during stopping of the engine is insufficient, combustion that takes place at the restart of the engine is hindered by the burned gas remaining in each cylinder and thus the restartability deteriorates. In view of this, for example, Japanese Patent Application Publication No. 2004-293474 (JP 2004-293474 A) describes a technique of increasing the opening degree of a throttle valve after an engine stopping condition is satisfied. This technique promotes scavenging of each cylinder to increase the ratio of the newly-taken air to the burned gas at the restart of the engine. As a result, more appropriate combustion takes place in each cylinder. This contributes to enhancement of the restartability.

BRIEF SUMMARY

With the technique described in JP 2004-293474 A, however, opening the throttle valve in the course of stopping the engine increases the in-cylinder pressure fluctuations, thereby making a driver feel stronger vibrations. On the other hand, when the throttle opening degree in the course of stopping the engine is decreased to reduce such vibrations, the effect of enhancing the restartability due to scavenging is undermined. As described above, thorough studies have not been made on how to achieve a good balance between reduction of vibrations and enhancement of the restartability.

The disclosure provides an engine starting system capable of enhancing the restartability while reducing vibrations.

An aspect of the disclosure relates to an engine starting system for a vehicle. The vehicle includes an engine and a transmission. The engine includes a plurality of cylinders and a throttle valve. The engine starting system includes an electronic control unit configured to: i) automatically stop the engine in response to a request to stop the engine, and restart the engine that is at a standstill after being automatically stopped, in response to a request to restart the engine; ii) calculate, in a course of automatically stopping the engine, a throttle opening degree based on at least one of a vehicle speed of the vehicle and an input rotational speed of the transmission, such that the throttle opening degree, when the at least one of the vehicle speed and the input rotational speed is higher than a predetermined threshold, is larger than the throttle opening degree when the at least one of the vehicle speed and the input rotational speed is lower than the predetermined threshold; iii) carry out scavenging of each of the cylinders of the engine by opening the throttle valve to the calculated throttle opening degree in the course of automatically stopping the engine; and iv) restart the engine through ignition-based engine starting in response to the request to restart the engine.

As described above, the engine starting system sets the throttle opening degree to a larger value when the vehicle speed is high than when the vehicle speed is low. This is because higher restartability is required when the vehicle speed is high than when the vehicle speed is low. In this way, it is possible to cause more appropriate combustion at the time of ignition-based engine starting, thereby enhancing the restartability. The driver is less likely to feel vibrations when the vehicle speed is high than when the vehicle speed is low. Therefore, the vibrations to be generated by opening the throttle valve are adjusted in accordance with the vehicle speed, in other words, the driver's sensitivity to the vibrations. Further, the engine starting system sets the throttle opening degree to a larger value when the rotational speed of the input shaft of the transmission is high, in other words, when the target rotational speed to be achieved after the restart of the engine is high, than when the rotational speed of the input shaft of the transmission is low. In this way, the responsiveness of the engine is enhanced.

In the engine starting system according to the above aspect of the disclosure, the electronic control unit may be configured to calculate the input rotational speed based on a vehicle speed at time when the request to stop the engine is issued and a speed-change ratio of the transmission at time when an accelerator pedal depression amount is zero.

Thus, even in the case where the transmission input rotational speed at the time when a request to stop the engine is issued is higher than necessary due to the occurrence of kickdown, the engine starting system calculates the throttle opening degree to be achieved in the course of automatically stopping the engine, based on the transmission input rotational speed calculated based on the transmission speed-change ratio at the time when the accelerator pedal is released. In this way, it is possible to prevent the throttle opening degree from becoming unnecessarily large, thereby making it possible to reduce vibrations.

In the engine starting system according to the above aspect of the disclosure, the vehicle may include a starting device, and the electronic control unit may be configured to determine whether the engine can be restarted through ignition-based engine starting, based on the calculated throttle opening degree. Further, the electronic control unit may be configured to restart the engine through ignition-based engine starting, when the electronic control unit determines that the engine can be restarted through ignition-based engine starting; and the electronic control unit may be configured to restart the engine by using the starting device without opening the throttle valve, when the electronic control unit determines that the engine cannot be restered through ignition-based engine starting.

With the engine starting system configured as described above, whether it is possible to start the engine through ignition-based engine starting is determined in advance. This makes it possible to avoid scavenging carried out due to unnecessary opening of the throttle valve, thereby reducing unexpectedly strong vibrations. In addition, even when the scavenging state or air density is not satisfactory and it is therefore not possible to execute ignition-based engine starting at the calculated allowable throttle opening degree, the engine starting system is able to reliably restart the engine.

The engine starting system described above adjusts the throttle opening degree in the course of automatically stopping the engine, based on at least one of the vehicle speed and the transmission input rotational speed. Thus, it is possible to enhance the restartability while reducing the vibrations.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, engine starting systems according to example embodiments of the disclosure will be described with reference to the accompanying drawings. Note that the disclosure should not be limited to the following embodiments. Further, examples of the elements constituting the following embodiments include not only those described below but also alternatives to those described below, which may be easily offered by a person skilled in the art, and elements substantially equivalent to those described below.

Figure 1:
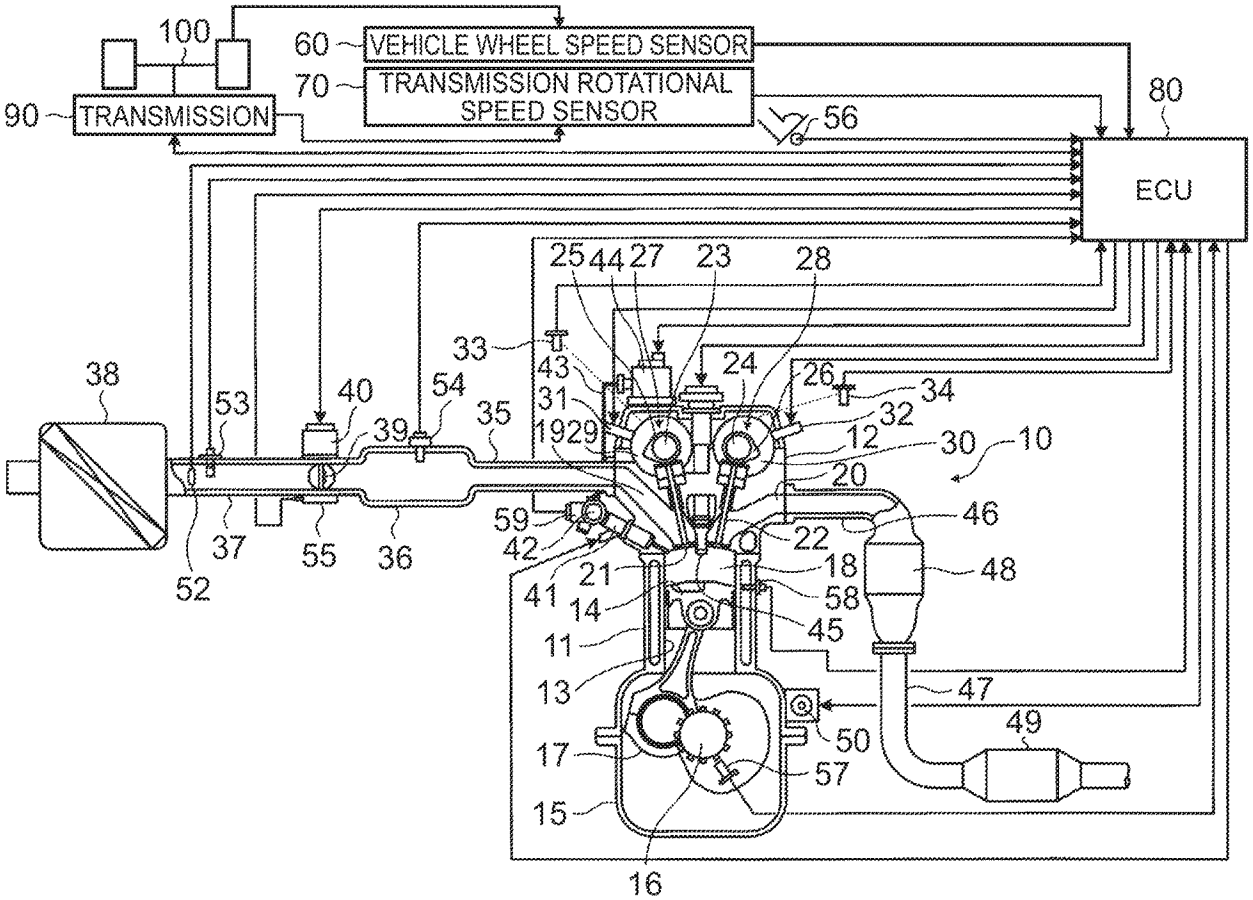
FIG. 1 is a block diagram illustrating an engine starting system according to an embodiment of the disclosure and the configurations in the vicinity of the engine starting system.

An engine starting system according to a first embodiment of the disclosure will be described with reference to FIGS. 1 to 4. As illustrated in FIG. 1, a vehicle provided with the engine starting system includes an engine 10, a vehicle wheel speed sensor 60, a transmission rotational speed sensor 70, an electronic control unit (ECU) 80, a transmission 90, and drive wheels 100. The engine 10 is an electronically-controlled internal combustion engine. Note that FIG. 1 illustrates only part of the vehicle configuration that is related to the disclosure, and the rest of the vehicle configuration that is not directly related to the disclosure is not illustrated in FIG. 1.

First, the configuration of the engine 10 will be described. The engine 10 is, for example, an in-cylinder injection engine having four cylinders. As illustrated in FIG. 1, the engine 10 includes a cylinder block 11, a cylinder head 12, cylinder bores 13, pistons 14, a crankcase 15, a crankshaft 16, and a connecting rod 17.

The cylinder head 12 is provided with injectors 41 that inject fuel directly into combustion chambers 18. The injectors 41 that are fitted to the respective cylinders are connected to each other via a delivery pipe 42. A high-pressure pump 44 is connected to the delivery pipe 42 via a fuel supply pipe 43. The cylinder head 12 is further provided with spark plugs 45.

Each combustion chamber 18 of the engine 10 is defined by the cylinder block 11, the cylinder head 12, and a corresponding one of the pistons 14. The central part of an upper portion of each combustion chamber 18 has a pent roof shape. An intake port 19 and an exhaust port 20 are provided on the upper portion of each combustion chamber 18 so as to be opposed to each other. An intake valve 21 is disposed at an opening of each intake port 19, and an exhaust valve 22 is disposed at an opening of each exhaust port 20.

The intake valves 21 and the exhaust valves 22 are supported by the cylinder head 12 so as to be movable along their axial directions. An intake camshaft 23 and an exhaust camshaft 24 are rotatably supported by the cylinder head 12. Intake cams 25 are in contact with upper end portions of the corresponding intake valves 21 via roller rocker arms (not illustrated). Similarly, exhaust cams 26 are in contact with upper end portions of the corresponding exhaust valves 22 via roller rocker arms (not illustrated). The intake camshaft 23 and the exhaust camshaft 24 are respectively provided with a cam position sensor 33 and a cam position sensor 34. The cam position sensor 33 and the cam position sensor 34 respectively detect the rotational phase of the intake camshaft 23 and the rotational phase of the exhaust camshaft 24.

The engine 10 further includes an intake variable valve timing (VVT) mechanism 27 and an exhaust variable valve timing (VVT) mechanism 28. The intake VVT mechanism 27 and the exhaust VVT mechanism 28 respectively control the intake valves 21 and the exhaust valves 22 so as to achieve the optimal opening timing and closing timing of the intake and exhaust valves 21, 22, based on the operation state. The intake VVT mechanism 27 advances and retards the opening timing and closing timing of the intake valves 21, by applying the hydraulic pressure from an oil control valve 31 to an advancing chamber (not illustrated) and a retarding chamber (not illustrated) of a VVT controller 29.

Similarly, the exhaust VVT mechanism 28 advances and retards the opening timing and closing timing of the exhaust valves 22, by applying the hydraulic pressure from an oil control valve 32 to an advancing chamber (not illustrated) and a retarding chamber (not illustrated) of a VVT controller 30.

A surge tank 36 is connected to the intake ports 19 via an intake manifold 35. An intake pipe 37 is connected to the surge tank 36. An air cleaner 38 is fitted to an air intake port of the intake pipe 37. An electronic throttle device 40 that includes a throttle valve 39 is disposed downstream of the air cleaner 38. An exhaust pipe 47 is connected to the exhaust port 20 via an exhaust manifold 46. The exhaust pipe 47 is provided with catalytic converters 48, 49.

The engine 10 is further provided with a starter motor 50 used to perform cranking (i.e., rotate the crankshaft 16 to start the engine 10). During starting of the engine 10, a pinion gear of the starter motor 50 is meshed with a ring gear, and then torque is transmitted from the pinion gear to the ring gear. As a result, the crankshaft 16 is rotated.

The ECU 80 is configured to control, for example, the injectors 41 and the spark plugs 45. An air flow sensor 52 and an intake air temperature sensor 53, which are disposed on the upstream side portion of the intake pipe 37, output the measured intake air amount and the measured intake air temperature to the ECU 80, respectively. The surge tank 36 is provided with an intake air pressure sensor 54. The intake air pressure sensor 54 outputs the measured intake pipe pressure (intake pipe negative pressure) to the ECU 80. A throttle position sensor 55 and an accelerator position sensor 56 output the measured present throttle opening degree and the measured present accelerator pedal depression amount to the ECU 80, respectively. A crank angle sensor 57, a coolant temperature sensor 58, and a fuel pressure sensor 59 output the measured crank angle, engine coolant temperature, and fuel pressure at each cylinder to the ECU 80, respectively The ECU 80 determines, based on the crank angle, which of the intake stroke, compression stroke, power (expansion) stroke, and exhaust stroke is presently taking place in each cylinder. Further, the ECU 80 calculates an engine speed. The ECU 80 drives the high-pressure pump 44 based on the fuel pressure such that the fuel pressure reaches a prescribed pressure. The ECU 80 determines, for example, a fuel injection amount, injection timing, and ignition timing, based on engine operation states such as the intake air amount, intake air temperature, intake pipe pressure, throttle opening degree, accelerator pedal depression amount, engine speed, and engine coolant temperature. Then, the ECU 80 controls the injectors 41 and the spark plugs 45 to perform fuel injection and ignition.

In the vehicle configured as described above, the ECU 80 has an engine automatic stop function and an engine restart function. The engine automatic stop function is a function of automatically stopping the engine 10 when a prescribed automatic stop condition is satisfied. The engine restart function is a function of automatically restarting the engine 10 when a prescribed restart condition is satisfied while the engine 10 is at a standstill after being automatically stopped. In other words, the engine starting system according to the present embodiment has a function of performing coasting (free run) and terminating the coasting. To perform coasting, the engine starting system automatically stops the engine 10 while the vehicle is travelling, to cause the vehicle to coast (to be moved by inertia). To terminate coasting, the engine starting system restarts the engine 10 to recover the vehicle from the coasting state.

Hereinafter, the configurations of components other than the engine 10 will be described. The vehicle wheel speed sensor 60 measures the rotational speed of each wheel of the vehicle and outputs the result of measurement to the ECU 80. The transmission rotational speed sensor 70 measures the number of rotations (revolutions) of an input shaft of the transmission 90 per unit time (hereinafter, referred to as "transmission input rotational speed"), and outputs the result of measurement to the ECU 80.

The ECU 80 is physically composed of an electronic circuit mainly including a known microcomputer. The microcomputer includes a central processing unit (CPU), a random-access memory (RAM), a read-only memory (ROM), and interfaces such as an input-output (IO) interface. The function of the ECU 80 is implemented in the following manner. An application program stored in the ROM is loaded into the RAM and then application program is executed by the CPU, whereby a controlled object is operated under control of the CPU. Further, the data in the RAM is read or written, or the data in the ROM is read. The engine starting system according to the present embodiment is realized through implementation of this function of the ECU 80.

The ECU 80 is configured to automatically stop the engine 10 mounted in the vehicle in response to a request to stop the engine 10, and to restart the engine 10 in response to a request to restart the engine 10 that is at a standstill after being automatically stopped. Specifically, in the course of automatically stopping the engine 10, the ECU 80 calculates a prescribed throttle opening degree based on the vehicle speed, and carries out scavenging of each cylinder of the engine 10 (i.e., expels exhaust gas from each cylinder of the engine 10) by opening the throttle valve 39 of the engine 10 to the calculated throttle opening degree. Then, the ECU 80 restarts the engine 10 through ignition-based engine starting in response to a request to restart the engine 10. Note that "ignition-based engine starting" means increasing the engine speed of the engine 10 by repeating a process in which fuel injection and ignition are carried out for a cylinder on its power stroke, among the multiple cylinders of the engine 10, and the air-fuel mixture in the cylinder on its power stroke is burned to generate torque. Note that "course of automatically stopping the engine 10" means a process from the start of automatically stopping the engine 10 to the completion of the automatic stop of the engine 10.

Specifically, the ECU 80 has the functions as a stop request determination unit, a throttle opening degree calculation-setting unit, a restart request determination unit, and a restart execution unit. Hereinafter, a concrete process executed by the engine starting system according to the present embodiment will be described with reference to a flowchart illustrated in FIG. 2. The engine starting system repeatedly executes the process in FIG. 2, which will be described below in detail, at prescribed time intervals while the vehicle is travelling.

The stop request determination unit determines whether there is a driver's request to stop the engine 10. Specifically, the stop request determination unit determines whether there is a driver's request to stop the engine 10, based on whether a condition for automatically stopping the engine 10 is satisfied while the vehicle is driven (step S1 in FIG. 2). Examples of the condition for automatically stopping the engine 10 include a condition that an accelerator pedal is released. When such a condition is satisfied, the stop request determination unit determines that the condition for automatically stopping the engine 10 is satisfied and therefore there is a request to stop the engine 10 ("Yes" in step S1 in FIG. 2).

Figure 2:
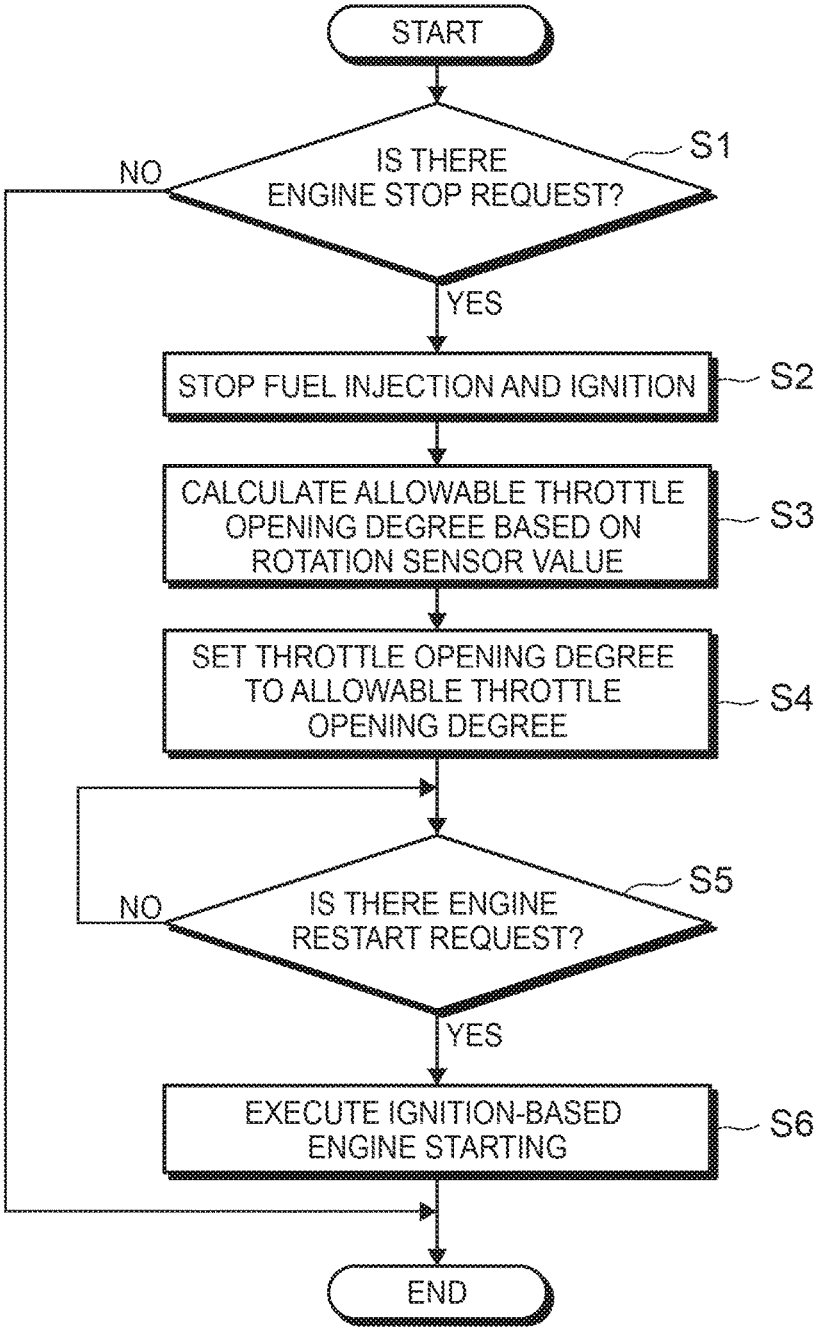
FIG. 2 is a flowchart illustrating an example of a process executed by the engine starting system according to a first embodiment of the disclosure.

When the stop request determination unit determines that there is the request to stop the engine 10, the ECU 80 stops fuel injection from the injectors 41 and stops ignition by the spark plugs 45 (step S2 in FIG. 2). The vehicle speed, engine speed, and engine coolant temperature that are used in making a determination as to whether there is a request to stop the engine 10 are obtained from the results of measurements performed by the vehicle wheel speed sensor 60, the crank angle sensor 57, and the coolant temperature sensor 58, respectively. On the other hand, when the stop request determination unit determines that there is no request to stop the engine 10 ("No" in step S1 in FIG. 2), the ECU 80 does not stop the engine 10.

The throttle opening degree calculation-setting unit calculates and sets a throttle opening degree to be achieved in the course of automatically stopping the engine 10. Specifically, when the stop request determination unit determines that there is the request to stop the engine 10 (when the condition for automatically stopping the engine 10 is satisfied), the throttle opening degree calculation-setting unit calculates a throttle opening degree that is allowed to be achieved in the course of automatically stopping the engine 10 (hereinafter, referred to as "allowable throttle opening degree"), based on a value detected by a rotation sensor (hereinafter, referred to as "rotation sensor value") mounted in the vehicle (step S3 in FIG. 2).

Specific examples of the rotation sensor value include a value (i.e., vehicle speed) detected by the vehicle wheel speed sensor 60. The allowable throttle opening degree specifically refers to a throttle opening degree that is to be achieved in the course of automatically stopping the engine 10, and at which the driver is less likely to feel vibrations due to in-cylinder pressure fluctuations in the course of automatically stopping the engine 10.

Figure 3:
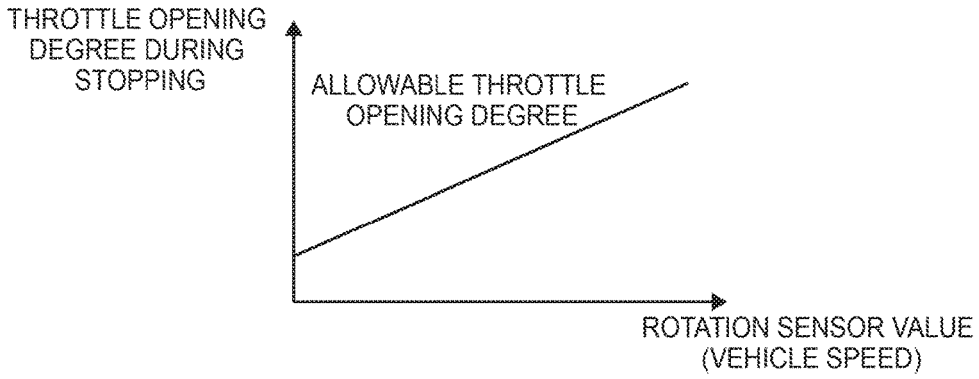
FIG. 3 is a graph illustrating an example of an allowable value of the throttle opening degree to be achieved in the course of automatically stopping an engine, which is set in accordance with the rotation sensor value (vehicle speed), in the engine starting system according to the first embodiment of the disclosure.

For example, as illustrated in FIG. 3, a map is stored in advance in the ROM (not illustrated) of the ECU 80. The map illustrated in FIG. 3 is experimentally obtained based on a vibration requirement that should be satisfied in the course of automatically stopping the engine 10. The map illustrated in FIG. 3 indicates the relationship between the vehicle speed and the allowable value of throttle opening degree in the course of automatically stopping the engine 10. The throttle opening degree calculation-setting unit calculates an allowable throttle opening degree to be achieved in the course of automatically stopping the engine 10, based on, for example, this map.

As illustrated in FIG. 3, the value of the allowable throttle opening degree to be achieved in the course of automatically stopping the engine 10 is larger when the vehicle speed is relatively high than when the vehicle speed is relatively low compared to a predetermined threshold. The allowable throttle opening degree may linearly increase in accordance with an increase in the vehicle speed as illustrated in FIG. 3, or may non-linearly increase (for example, in a stepwise manner) in accordance with an increase in the vehicle speed.

Figure 4:
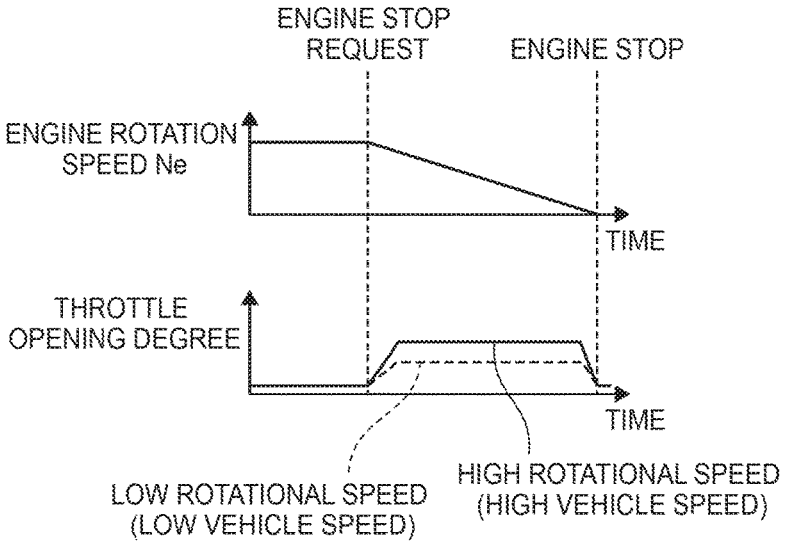
FIG. 4 is a time-series chart illustrating the relationship between the engine speed and the throttle opening degree, in the engine starting system according to the first embodiment of the disclosure.
Figure 5:
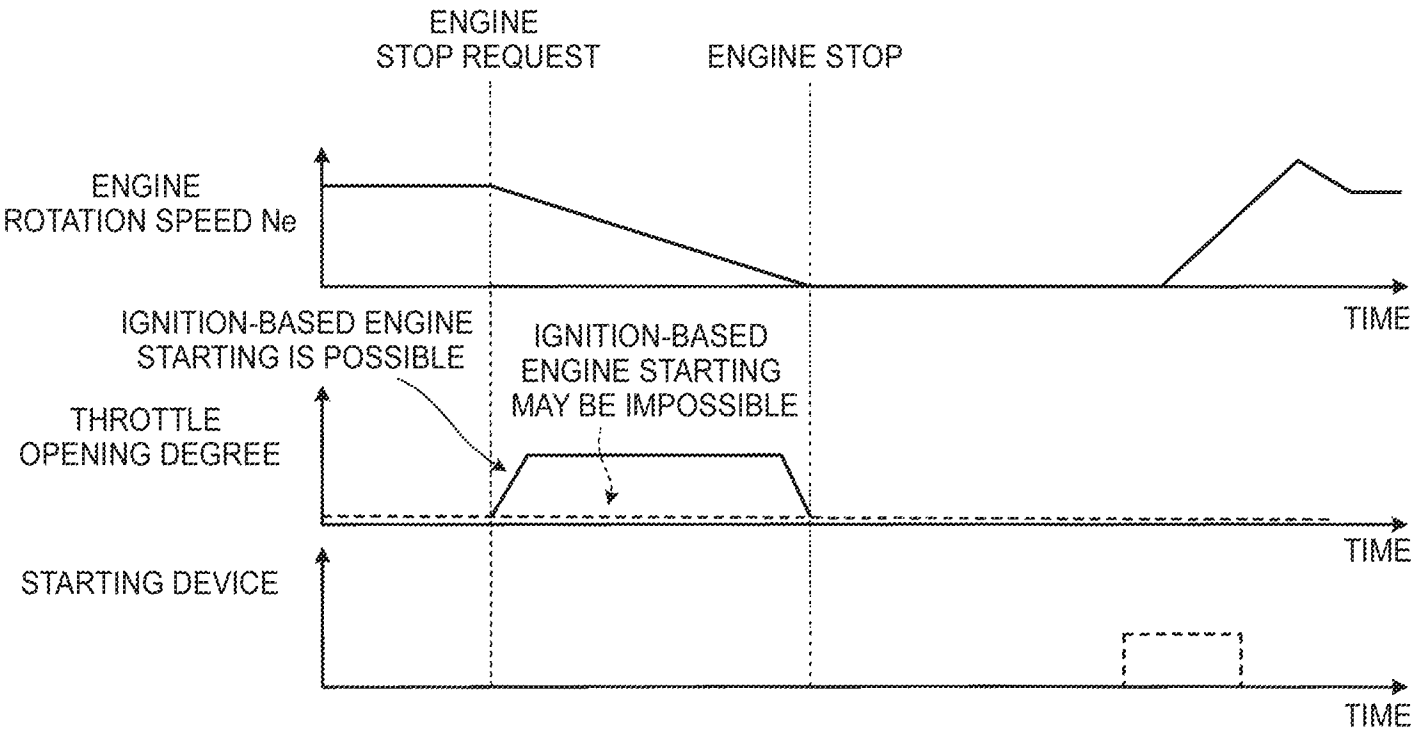
FIG. 5 is a time-series chart illustrating the relationship among the engine speed, the throttle opening degree, and a starting device, in an engine starting system according to a second embodiment of the disclosure.

When the vehicle speed (vehicle wheel speed) is high, the vibrations of the vehicle become strong due to, for example, air resistance. Thus, even when the throttle valve 39 is opened to a large degree while the vehicle is travelling at high speed, the vibrations due to in-cylinder pressure fluctuations are merged into the vibrations due to travelling motion of the vehicle. As a result, the driver is less likely to feel the vibrations due to in-cylinder pressure fluctuations. In addition, when the vehicle speed is high, the engine speed needs to be quickly increased to a rotational speed that is synchronized with the rotational speed of the input shaft of the transmission 90 after the engine 10 is restarted. Thus, it is necessary not only to quickly restart the engine 10 but also to quickly increase the engine speed. In view of such high responsiveness as well, when the vehicle speed is high, the throttle valve 39 is opened to a large degree as illustrated in FIG. 4.

On the other hand, when the vehicle speed (vehicle wheel speed) is low, the vibrations of the vehicle are not so strong. Especially when the vehicle is brought to a standstill, the vibrations become especially weak. Thus, when throttle valve 39 is opened to a large degree while the vehicle is travelling at low speed, the driver is likely to feel the vibrations due to in-cylinder pressure fluctuations. In addition, when the vehicle speed is low, the engine speed that is synchronized with the rotational speed of the input shaft of the transmission 90 after the engine 10 is restarted is low. Thus, it is not necessary to quickly increase the engine speed unlike when the vehicle is travelling at high speed. For this reason, the throttle valve 39 is opened to a smaller degree when the vehicle speed is low than when the vehicle speed is high, as illustrated in FIG. 4.

When the engine 10 is restarted through ignition-based engine starting, it is preferable that scavenging of the cylinders be sufficiently carried out and the density of air be high. Thus, opening the throttle valve 39 to a larger degree in the course of automatically stopping the engine 10 makes it easier to restart the engine 10. However, when the throttle opening degree is increased, the in-cylinder pressure fluctuations increase, and, consequently, increases in vibrations of the vehicle become unavoidable.

On the other hand, when the throttle opening degree is decreased to reduce vibrations of the vehicle, scavenging becomes less effective. In this case, it is not possible to deal with situations where high restartability of the engine 10 is required, such as a situation where the vehicle speed is high. In this regard, the throttle opening degree calculation-setting unit calculates an allowable throttle opening degree such that the allowable throttle opening degree is larger when the vehicle speed is high than when the vehicle speed is low. The throttle opening degree calculation-setting unit calculates the allowable throttle opening degree in this way in order to make it possible both to reduce vibrations and to enhance the restartability when the engine 10 is restarted through ignition-based engine starting.

After calculating the allowable throttle opening degree as described above, the throttle opening degree calculation-setting unit causes the electronic throttle device 40 to open the throttle valve 39, and then sets the opening degree of the throttle valve 39 to the calculated allowable throttle opening degree (step S4 in FIG. 2). When the throttle valve 39 is opened in the course of automatically stopping the engine 10 as described above, the air in the intake pipe 37 flows into the surge tank 36 via the throttle valve 39 and the intake pipe pressure increases to a positive pressure. As a result, the piston 14, which stops on the power stroke, stops at a prescribed stop position on the power stroke, the inflow of air causes scavenging of each cylinder, and thus an appropriate amount of oxygen is obtained in the cylinder that is deactivated on its power stroke. When the engine speed becomes zero and thus the engine 10 is completely stopped, the throttle opening degree calculation-setting unit causes the electronic throttle device 40 to close the throttle valve 39 (refer to FIG. 4).

The restart request determination unit determines whether there is a driver's request to restart the engine 10 (hereinafter, referred to as "restart request" where appropriate). Specifically, the restart request determination unit determines whether there is a restart request, based on whether a restart condition for restarting the engine 10 is satisfied while the engine 10 is at a standstill after being automatically stopped (step S5 in FIG. 2). Examples of the restart condition include a condition that the accelerator pedal is depressed. When such a condition is satisfied, the restart request determination unit determines that the restart condition is satisfied and thus there is a restart request ("Yes" in step S5 in FIG. 2). When the restart condition is not satisfied, the restart request determination unit determines that there is no restart request ("No" in step S5 in FIG. 2) and waits until a restart request is issued.

The restart execution unit restarts the engine 10 that is at a standstill after being automatically stopped, through ignition-based engine starting. When the restart request determination unit determines that there is the request to restart the engine 10, the restart execution unit executes ignition-based engine starting to restart the engine 10 (step S6 in FIG. 2). Specifically, the restart execution unit identifies the cylinder that is deactivated on its power stroke, based on the result of measurement performed by the crank angle sensor 57 before restarting the engine 10, and causes the injector 41 to inject a prescribed amount of fuel to the combustion chamber 18 of the cylinder that is deactivated on its power stroke. Then, the restart execution unit causes the spark plug 45 to ignite an air-fuel mixture to obtain explosive power, thereby driving the crankshaft 16 using the piston 14 to restart the engine 10.

With the engine starting system according to the first embodiment, the throttle opening degree to be achieved in the course of automatically stopping the engine 10 is adjusted in accordance with the vehicle speed. This makes it possible to reduce vibrations and to enhance the restartability.

The engine starting system sets the throttle opening degree to a larger value when the vehicle speed is high than when the vehicle speed is low. This is because higher restartability is required when the vehicle speed is high than when the vehicle speed is low. In this way, it is possible to cause more appropriate combustion at the time of ignition-based engine starting, thereby enhancing the restartability. The driver is less likely to feel vibrations due to stopping of the engine 10 when the vehicle speed is high than when the vehicle speed is low. Therefore, the vibrations to be generated by opening the throttle valve 39 are adjusted in accordance with the vehicle speed, in other words, the driver's sensitivity to the vibrations.

More detailed description will be provided below. When the vehicle speed is high, the throttle opening degree is set large. However, the vibrations due to the in-cylinder pressure fluctuations are merged into the vibrations due to a travelling motion of the vehicle, and thus the driver is less likely to feel the vibrations due to the in-cylinder pressure fluctuations. On the other hand, when the vehicle speed is low, the throttle opening degree is set small. As a result, it is possible to reduce the in-cylinder pressure fluctuations, thereby reducing the vibrations. That is, with the engine starting system, it is possible both to reduce vibrations in the course of automatically stopping the engine 10 and to enhance the restartability.

Next, an engine starting system according to a second embodiment of the disclosure will be described with reference to FIGS. 5 to 8. The engine starting system according to the second embodiment has the same configurations as those in the first embodiment (FIG. 1) except the configuration of the ECU 80. Therefore, illustration of the configurations of the engine starting system according to the second embodiment will be omitted.

Like the engine starting system according to the first embodiment, the engine starting system according to the second embodiment is realized through implementation of the function of the ECU 80. However, the ECU 80 according to the present embodiment has the function as an ignition-based engine starting executability determination unit, in addition to the functions as the stop request determination unit, the throttle opening degree calculation-setting unit, the restart request determination unit, and the restart execution unit.

Figure 6:
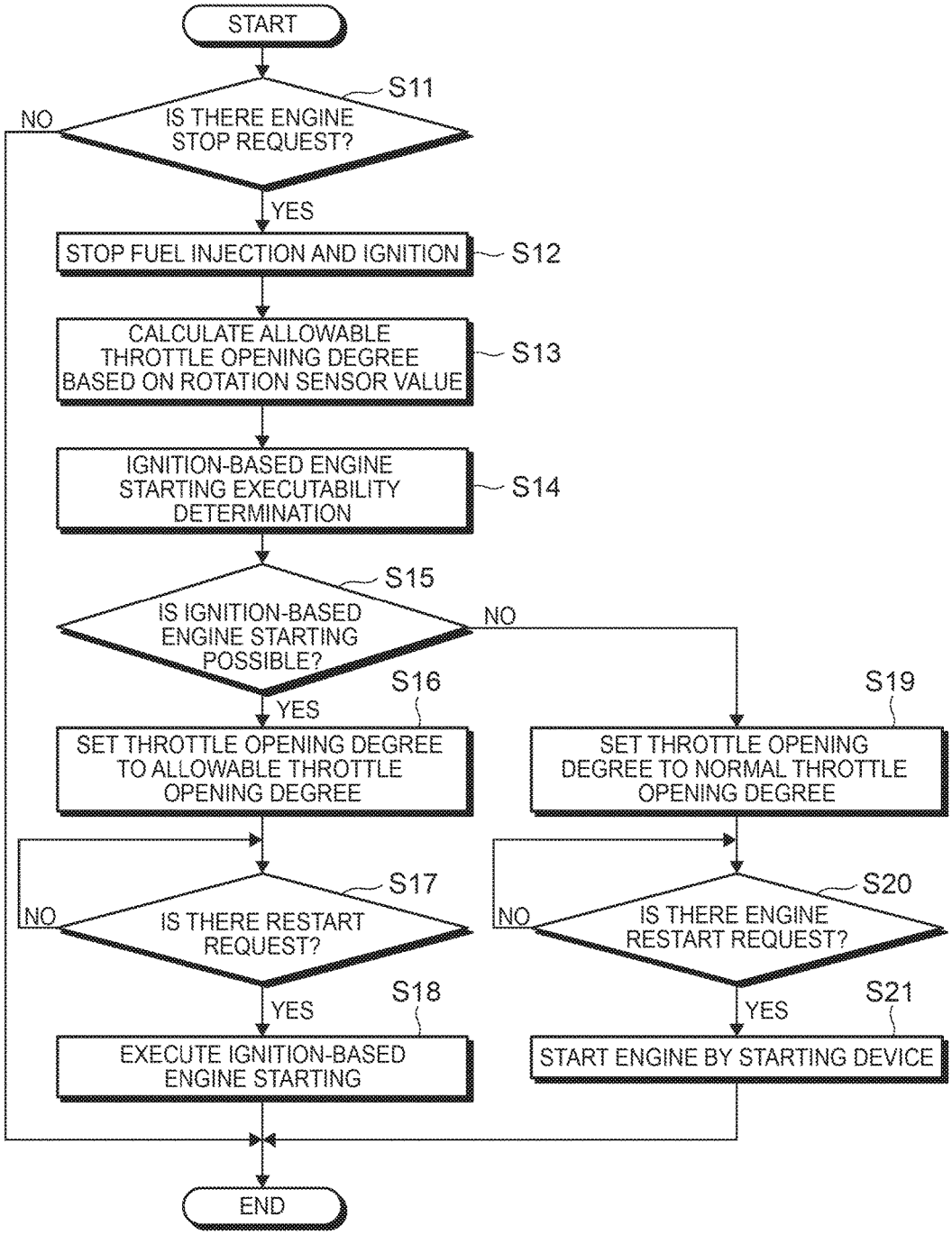
FIG. 6 is a flowchart illustrating an example of a process executed by the engine starting system according to the second embodiment of the disclosure.

That is, the engine starting system according to the present embodiment executes the operation described below in addition to the operation executed by the engine starting system according to the first embodiment. Specifically, the engine starting system according to the present embodiment determines whether it is possible to restart the engine 10 through ignition-based engine starting. When it is possible to restart the engine 10 through ignition-based engine starting, the engine starting system restarts the engine 10 using an ignition device (ignition plug 45). On the other hand, when it is not possible to restart the engine 10 through ignition-based engine starting, the engine starting system restarts the engine 10 using a starting device (starter motor 50) that is commonly used to restart the engine 10. Hereinafter, a concrete process executed by the engine starting system according to the present embodiment will be described with reference to flowcharts illustrated in FIG. 6 and FIG. 7. Steps S11 to S13, step S17, and step S18 in FIG. 6 are the same as steps S1 to S3, step S5, and step S6 in FIG. 2, respectively. Therefore, description on these steps will be omitted. The engine starting system repeatedly executes the processes in FIG. 6 and FIG. 7, which will be described below in detail, at prescribed time intervals while the vehicle is travelling.

The ignition-based engine starting executability determination unit determines whether it is possible to restart the engine 10 through ignition-based engine starting, based on the throttle opening degree (allowable throttle opening degree) calculated by the throttle opening degree calculation-setting unit (step S14 in FIG. 6). Specifically, the ignition-based engine starting executability determination unit determines whether it is possible to restart the engine 10 through ignition-based engine starting, by comparing the torque that is required to restart the engine 10 with an estimated generation torque that is obtained through calculation. Note that "estimated generation torque" means a value of torque that is calculated on the assumption that the throttle opening degree is set to the throttle opening degree calculated by the throttle opening degree calculation-setting unit in the course of automatically stopping the engine 10 and then ignition-based engine starting is executed.

Hereinafter, the details of an ignition-based engine starting executability determination process in step S14 in FIG. 6 will be described with reference to FIG. 7. In this process, first, the ignition-based engine starting executability determination unit estimates an intake pipe pressure (step S141). Note that "intake pipe pressure" means a pressure in the intake pipe 37 at the time when the air is taken into a cylinder on its power stroke in the course of automatically stopping the engine 10. The ignition-based engine starting executability determination unit estimates the intake pipe pressure in the course of automatically stopping the engine 10, based on, for example, the engine speed and coolant temperature detected when a request to stop the engine 10 is issued, and the allowable throttle opening degree calculated by the throttle opening degree calculation-setting unit.

Then, the ignition-based engine starting executability determination unit estimates a stop-time in-cylinder air density (step S142). The ignition-based engine starting executability determination unit estimates the air density, for example, based on the stop-time intake pipe pressure and the stop-time valve timing, at a crank angle within a range of crank angles at which the crankshaft 16 is estimated to stop. The stop position of the piston 14, in other words, the stop position of the crankshaft 16, can be adjusted to be within a range of approximately ±20° with respect to the center value. Thus, the range of crank angles at which the crankshaft 16 is estimated to stop means a range of approximately ±20° with respect to the position (angle) at which the crankshaft 16 is desired to be stopped.

Next, the ignition-based engine starting executability determination unit estimates a temporal change in the in-cylinder air density (step S143). Specifically, the ignition-based engine starting executability determination unit estimates the temporal change in the in-cylinder air density by estimating an amount of air that leaks out of the cylinder at each engine stoppage time (i.e., time that has elapsed since the engine 10 is stopped).

Figure 8:
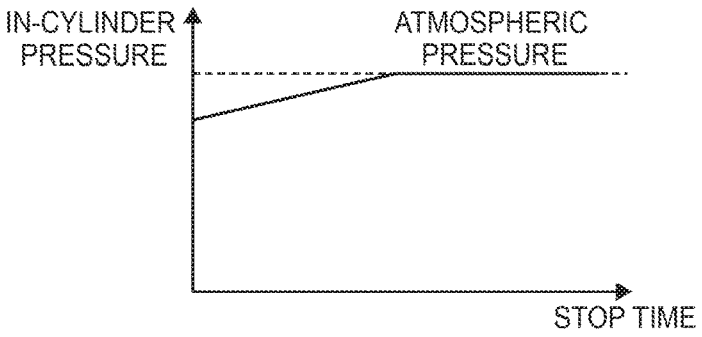
FIG. 8 is a graph illustrating the relationship between the engine stoppage time and the in-cylinder pressure, in the engine starting system according to the second embodiment of the disclosure.

Next, the ignition-based engine starting executability determination unit estimates a generation torque (step S144). Specifically, the ignition-based engine starting executability determination unit estimates a value of torque that is generated when the engine stoppage time and the stop-time crank angle are values at which torque is least likely to be generated at the restart of the engine 10. When the allowable throttle opening degree is small, the intake pipe pressure is low and the stop-time in-cylinder pressure is low. However, the air flows into the cylinder through a gap in the piston ring with the lapse of time, and thus the in-cylinder pressure approaches the atmospheric pressure with the lapse of time as illustrated in FIG. 8. Therefore, when the allowable throttle opening degree is small, the engine stoppage time at which torque is least likely to be generated at the restart of the engine 10 is a time immediately after the engine 10 is stopped.

Next, the ignition-based engine starting executability determination unit determines whether it is possible to restart the engine 10 through ignition-based engine starting, based on the result of estimation described above (step S145). Specifically, the ignition-based engine starting executability determination unit compares the torque that is required to restart the engine 10 with the estimated generation torque that is obtained in step S144. When the estimated generation torque is higher than the torque required to restart the engine 10, the ignition-based engine starting executability determination unit determines that it is possible to restart the engine 10 through ignition-based engine starting. On the other hand, when the estimated generation torque is lower than the torque required to restart the engine 10, the ignition-based engine starting executability determination unit determines that it is not possible to restart the engine 10 through ignition-based engine starting.

Figure 7:
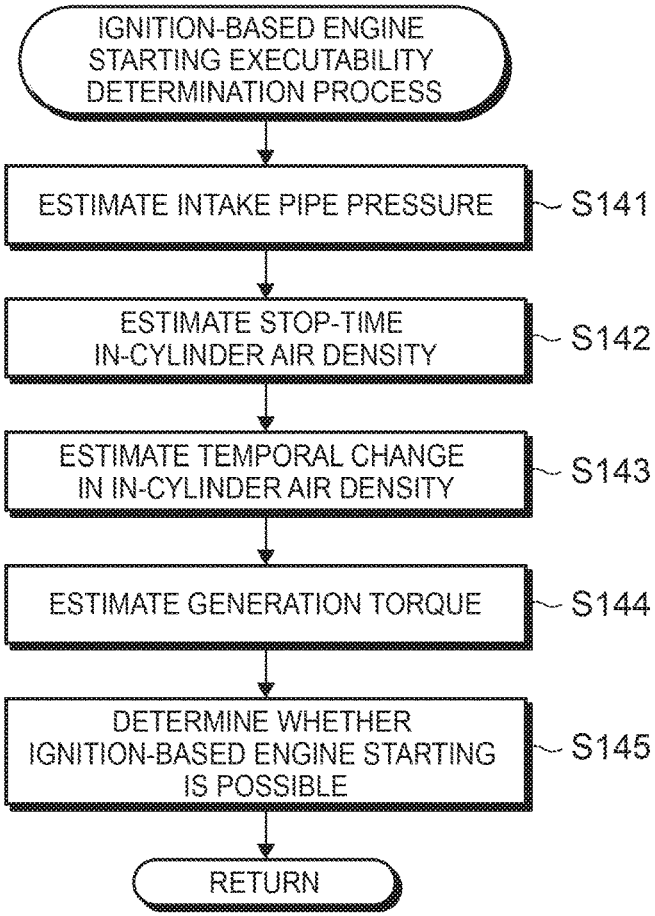
FIG. 7 is a flowchart illustrating an example of an ignition-based engine starting executability determination process included in the process executed by the engine starting system according to the second embodiment of the disclosure.

When the ignition-based engine starting executability determination unit determines, through the process in FIG. 7, that it is possible to restart the engine 10 through ignition-based engine starting ("Yes" in step S15 in FIG. 6), the throttle opening degree calculation-setting unit opens the throttle valve 39 and sets the throttle opening degree to the calculated allowable throttle opening degree (step S16 in FIG. 6). After the restart request determination unit determines that there is a request to restart the engine 10 ("Yes" in step S17 in FIG. 6), the restart execution unit restarts the engine 10 through ignition-based engine starting (step S18 in FIG. 6).

On the other hand, when the ignition-based engine starting executability determination unit determines that it is not possible to restart the engine 10 through ignition-based engine starting ("No" in step S15 in FIG. 6), the throttle opening degree calculation-setting unit does not open the throttle valve 39 and sets the throttle opening degree to the normal degree at which the throttle valve 39 is closed, in the course of automatically stopping the engine 10 (step S19 in FIG. 6). After the restart request determination unit determines that there is a request to restart the engine 10 ("Yes" in step S20 in FIG. 6), the restart execution unit restarts the engine 10 with the use of the starting device (step S21 in FIG. 6).

With the engine starting system according to the second embodiment, whether it is possible to start the engine 10 through ignition-based engine starting is determined in advance. This makes it possible to avoid scavenging carried out due to unnecessary opening of the throttle valve 39, thereby reducing unexpectedly vibrations. In addition, even when the scavenging state or air density is not satisfactory and it is therefore not possible to execute ignition-based engine starting at the calculated allowable throttle opening degree, the engine starting system is able to reliably restart the engine 10.

Next, an engine starting system according to a third embodiment of the disclosure will be described with reference to FIG. 9 and FIG. 10. The engine starting system according to the third embodiment has the same configurations as those in the first embodiment (FIG. 1) except the configuration of the ECU 80. Therefore, illustration of the configurations of the engine starting system according to the third embodiment will be omitted.

Like the engine starting system according to the first embodiment, the engine starting system according to the third embodiment is realized through implementation of the function of the ECU 80. However, the ECU 80 according to the present embodiment differs from that according to the first embodiment in that the throttle opening degree calculation-setting unit calculates an allowable throttle opening degree based on the transmission input rotational speed (rotational speed of the input shaft of the transmission 90) that is measured by the transmission rotational speed sensor 70.

When the engine 10 is restarted immediately after the engine 10 is stopped, the transmission input rotational speed is used as a target rotational speed to be achieved after the restart of the engine 10. In this case, the higher the transmission input rotational speed is, the larger the opening degree of the throttle valve 39 needs to be. Thus, as illustrated in FIG. 9 and FIG. 10, the throttle opening degree calculation-setting unit of the engine starting system according to the present embodiment calculates the throttle opening degree such that the throttle opening degree when the transmission input rotational speed is relatively high is larger than the throttle opening degree when the transmission input rotational speed is relatively low compared to a predetermined threshold.

Figure 9:
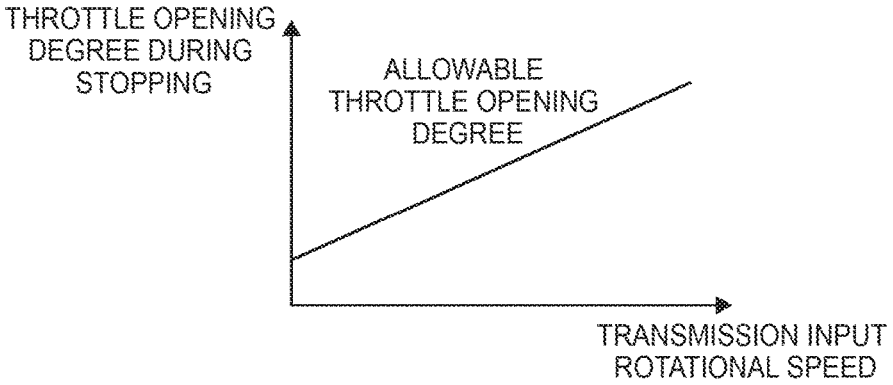
FIG. 9 is a graph illustrating an example of an allowable value of the throttle opening degree to be achieved in the course of automatically stopping an engine, which is set in accordance with the transmission input rotational speed, in the engine starting system according to a third embodiment of the disclosure.
Figure 10:
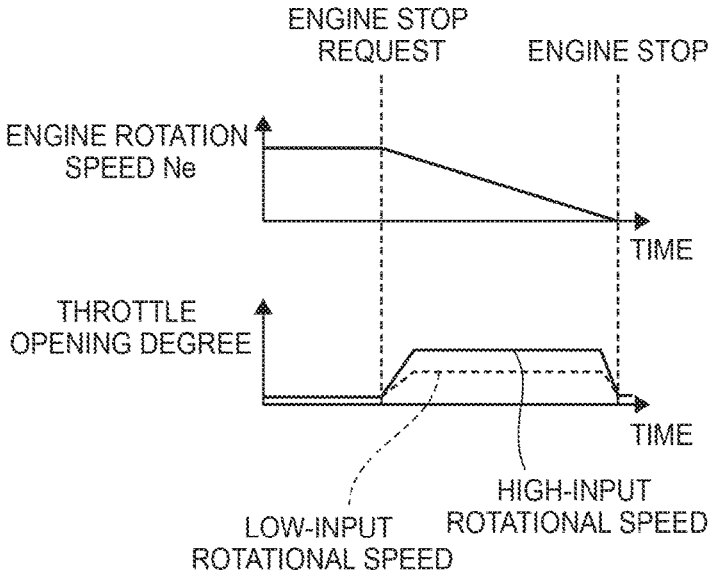
FIG. 10 is a time-series chart illustrating the relationship between the engine speed and the throttle opening degree, in the engine starting system according to the third embodiment of the disclosure.

For example, as illustrated in FIG. 9, a map is stored in advance in the ROM (not illustrated) of the ECU 80. The map illustrated in FIG. 9 is experimentally obtained based on a vibration requirement that should be satisfied in the course of automatically stopping the engine 10. The map illustrated in FIG. 9 indicates the relationship between the transmission input rotational speed and the allowable value of throttle opening degree in the course of automatically stopping the engine 10. The throttle opening degree calculation-setting unit calculates an allowable throttle opening degree to be achieved in the course of automatically stopping the engine 10, based on, for example, this map.

With the engine starting system according to the third embodiment, the throttle opening degree to be achieved in the course of automatically stopping the engine 10 is adjusted in accordance with the transmission input rotational speed. This makes it possible to reduce vibrations and to enhance the restartability. The engine starting system sets the throttle opening degree to a larger value when the rotational speed of the input shaft of the transmission 90 is high, in other words, when the target rotational speed to be achieved after the restart of the engine 10 is high, than when the rotational speed of the input shaft of the transmission 90 is low. In this way, the responsiveness of the engine 10 is enhanced.

An engine starting system according to a modified example of the third embodiment of the disclosure will be described with reference to FIG. 11 and FIG. 12. The engine starting system according to the modified example of the third embodiment has the same configurations as those in the first embodiment (FIG. 1) except the configuration of the ECU 80. Therefore, illustration of the configurations of the engine starting system according to the modified example of the third embodiment will be omitted.

Like the engine starting system according to the first embodiment, the engine starting system according to the modified example of the third embodiment is realized through implementation of the function of the ECU 80. However, the ECU 80 according to this modified example has the function as a transmission input rotational speed calculation unit, in addition to the functions as the stop request determination unit, the throttle opening degree calculation-setting unit, the restart request determination unit, and the restart execution unit.

In the vehicle provided with the engine starting system according to the third embodiment, there may be a case where, for example, immediately before a request to stop the engine 10 is issued, downshifting of the transmission 90 is performed by largely depressing the accelerator pedal (kickdown), the speed-change ratio of the transmission 90 (hereinafter, referred to as "transmission speed-change ratio") becomes higher, and the transmission input rotational speed becomes higher than necessary. If the accelerator pedal is released in this state, the request to stop the engine 10 is issued while the engine speed and the transmission input rotational speed are both high as illustrated in FIG. 11. As illustrated in FIG. 11, if the allowable throttle opening degree is calculated and set based on the actual value of the transmission input rotational speed, the throttle opening degree may become unnecessarily large and stronger vibrations may be generated in the course of automatically stopping the engine 10.

Figure 11:
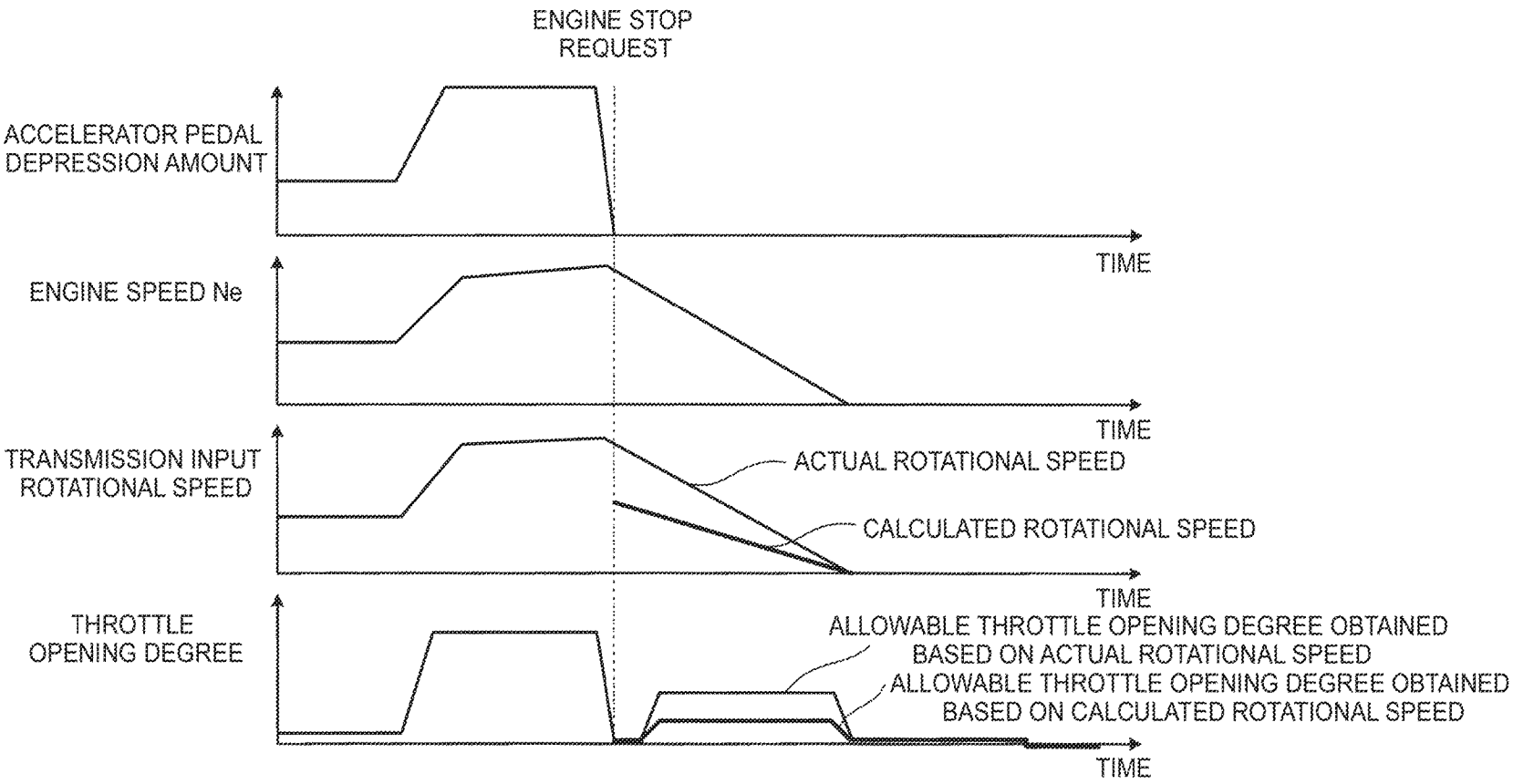
FIG. 11 is a time-series chart illustrating the relationship among the accelerator pedal depression amount, the engine speed, the transmission input rotational speed, and the throttle opening degree, in an engine starting system according to a modified example of the third embodiment of the disclosure.

In view of this, when kickdown occurs, the engine starting system according to this modified example uses the rotational speed calculated by the transmission input rotational speed calculation unit, instead of using the actual value of the transmission input rotational speed, as illustrated in FIG. 11. Hereinafter, a concrete process executed by the engine starting system according to this modified example will be described with reference to a flowchart illustrated in FIG. 12. Step S21, step S22, and steps S25 to S27 in FIG. 12 are the same as step S1, step S2, and steps S4 to S6 in FIG. 2, respectively. Therefore, description on these steps will be omitted. The engine starting system repeatedly executes the process in FIG. 12, which will be described below in detail, at prescribed time intervals while the vehicle is travelling.

Figure 12:
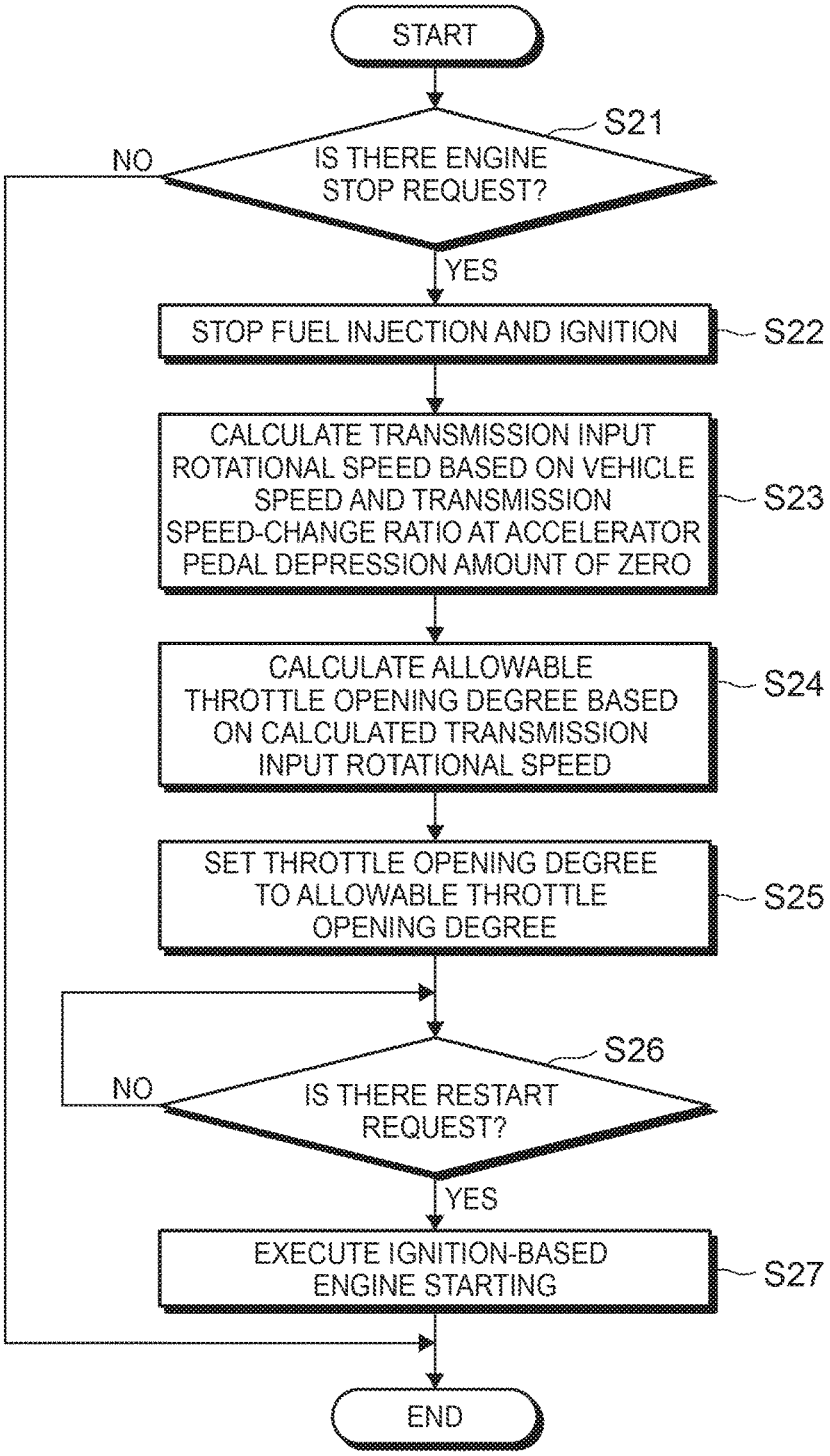
FIG. 12 is a flowchart illustrating an example of a process executed by the engine starting system according to the modified example of the third embodiment of the disclosure.

The transmission input rotational speed calculation unit calculates a transmission input rotational speed, based on the vehicle speed at the time when a request to stop the engine 10 is issued (when the automatic stop condition is satisfied) and the transmission speed-change ratio at the time when the accelerator pedal depression amount is zero (step S23 in FIG. 12). Thus, even when kickdown occurs, the transmission input rotational speed that is lower than the actual rotational speed is calculated as illustrated in FIG. 11.

For example, in the case where the transmission speed-change ratio is subjected to kickdown from 5th speed to 3rd speed when a request to stop the engine 10 is issued, the transmission input rotational speed calculation unit first calculates a transmission input rotational speed, based on the vehicle speed at the time when a request to stop the engine 10 is issued and the transmission speed-change ratio at the time when the accelerator pedal depression amount is zero (5th speed), instead of calculating the allowable throttle opening degree based on the transmission input rotational speed at 3rd speed, which is the actual rotational speed. Then, the throttle opening degree calculation-setting unit of the engine starting system calculates an allowable throttle opening degree based on the calculated transmission input rotational speed (step S24 in FIG. 12).

Even in the case where the transmission input rotational speed at the time when a request to stop the engine 10 is issued is higher than necessary due to the occurrence of kickdown, the engine starting system according to the modified example of the third embodiment, which is configured as described above, calculates the throttle opening degree to be achieved in the course of automatically stopping the engine 10, based on the transmission input rotational speed calculated based on the transmission speed-change ratio at the time when the accelerator pedal is released. In this way, it is possible to prevent the throttle opening degree from becoming unnecessarily large, thereby making it possible to reduce vibrations.

While the engine starting systems according to the embodiments of the disclosure and the modified example thereof haven been described in detail, the disclosure should not be limited to the embodiments and modified example described above. The technical scope of the disclosure should be defined by claims, and various changes and modifications within the scope of the claims are therefore intended to be included in the disclosure.

For example, the engine starting systems according to the first embodiment, the third embodiment, and the modified example of the third embodiment may be configured such that an ignition-based engine starting executability determination unit executes an ignition-based engine starting executability determination process after the allowable throttle opening degree is calculated by the throttle opening degree calculation-setting unit, as in the second embodiment. Thus, even when it is determined that the engine 10 cannot be started through ignition-based engine starting at the allowable throttle opening degree calculated by the throttle opening degree calculation-setting unit, it is possible to reliably restart the engine 10.

The engine starting system according to the first embodiment calculates the allowable throttle opening degree based on the vehicle speed, and the engine starting systems according to the third embodiment and the modified example of the third embodiment each calculate the allowable throttle opening degree based on the transmission input rotational speed. However, for example, allowable throttle opening degrees may be obtained respectively based on the vehicle speed and the transmission input rotational speed and the final allowable throttle opening degree may be determined by conducting coordination between these allowable throttle opening degrees.

What is claimed is:

1. An engine starting system for a vehicle, the vehicle including an engine and a transmission, and the engine including a plurality of cylinders and a throttle valve, the engine starting system comprising:

a starting device; and an electronic control unit configured to:

automatically stop the engine in response to a request to stop the engine;

calculate, in a course of automatically stopping the engine, an allowable throttle opening degree based on at least one of a vehicle speed of the vehicle or an input rotational speed of the transmission, such that the calculated allowable throttle opening degree, when the at least one of the vehicle speed or the input rotational speed is higher than a predetermined threshold, is larger than the calculated allowable throttle opening degree when the at least one of the vehicle speed or the input rotational speed is lower than the predetermined threshold;

determine whether the engine can be started through ignition-based engine starting, when a torque that is required to restart the engine is higher than an estimated generation torque based on an estimated intake pipe pressure based on the calculated allowable throttle opening degree, an estimated stop-time in-cylinder air density based on a crank angle at which a crankshaft of the engine is estimated to stop, and an estimated temporal change in an in-cylinder air density;

carry out scavenging of each of the cylinders of the engine by opening the throttle valve to the calculated allowable throttle opening degree in the course of automatically stopping the engine, when the electronic control unit determines that the engine can be restarted through ignition-based engine starting;

restart the engine, which is at a standstill after being automatically stopped, in response to a request to restart the engine through ignition-based engine starting, when the electronic control unit determines that the engine can be restarted through ignition-based engine starting; and restart the engine, which is at a standstill after being automatically stopped, in response to the request to restart the engine by using the starting device without opening the throttle valve, when the electronic control unit determines that the engine cannot be restarted through ignition-based engine starting.

2. The engine starting system according to claim 1, wherein the electronic control unit is configured to calculate the input rotational speed based on a vehicle speed at time when the request to stop the engine is issued and a speed-change ratio of the transmission at time when an accelerator pedal depression amount is zero.

3. A method for starting an engine of a vehicle, the vehicle including an engine and a transmission, and the engine including a plurality of cylinders and a throttle valve, the method comprising:

automatically stopping the engine in response to a request to stop the engine;

calculating, in a course of automatically stopping the engine, an allowable throttle opening degree based on at least one of a vehicle speed of the vehicle or an input rotational speed of the transmission, such that the calculated allowable throttle opening degree, when the at least one of the vehicle speed or the input rotational speed is higher than a predetermined threshold, is larger than the calculated allowable throttle opening degree when the at least one of the vehicle speed or the input rotational speed is lower than the predetermined threshold;

determining whether the engine can be started through ignition-based engine starting, when a torque that is required to restart the engine is higher than an estimated generation torque based on an estimated intake pipe pressure based on the calculated allowable throttle opening degree, an estimated stop-time in-cylinder air density based on a crank angle at which a crankshaft of the engine is estimated to stop, and an estimated temporal change in an in-cylinder air density;

carrying out scavenging of each of the cylinders of the engine by opening the throttle valve to the calculated allowable throttle opening degree in the course of automatically stopping the engine, when it is determined that the engine can be started through ignition-based engine starting; and restarting the engine, which is at is at a standstill after being automatically stopped, in response to a request to restart the engine through ignition-based engine starting, when it is determined that the engine can be restarted through ignition-based engine starting; and restarting the engine, which is at is at a standstill after being automatically stopped, in response to the request to restart the engine by using a starting device without opening the throttle valve, when it is determined that the engine cannot be restarted through ignition-based engine starting.

4. The method according to claim 3, further comprising calculating the input rotational speed based on a vehicle speed at time when the request to stop the engine is issued and a speed-change ratio of the transmission at time when an accelerator pedal depression amount is zero.

* * * * *